United States Patent [19]

Andreadakis

[11] Patent Number: 4,490,647

[45] Date of Patent: Dec. 25, 1984

[54] GAS-FILLED DOT MATRIX DISPLAY PANEL

[75] Inventor: Nicholas C. Andreadakis, Branchburg, N.J.

[73] Assignee: Burroughs Corporation, Detroit, Mich.

[21] Appl. No.: 445,209

[22] Filed: Nov. 29, 1982

[51] Int. Cl.[3] ..... H01J 17/49; G09G 3/28

[52] U.S. Cl. ..... 313/586; 340/714; 315/169.1

[58] Field of Search ..... 40/447; 340/714, 716, 340/769, 771, 792, 799; 315/169.1, 169.2, 169.3, 169.4; 313/584, 562, 586, 585

[56] References Cited

U.S. PATENT DOCUMENTS

| | | | |
|---|---|---|---|
| 3,701,924 | 10/1972 | Glaser | 315/169.1 |
| 3,704,386 | 11/1972 | Cola | 315/169.1 |
| 3,714,506 | 1/1973 | Kupsky | 315/169.1 |
| 3,766,420 | 10/1973 | Ogle et al. | 313/584 |
| 3,872,346 | 3/1975 | Kunii | 315/169.1 |
| 3,878,422 | 4/1975 | Brown et al. | 315/169.1 |
| 4,162,427 | 7/1979 | Kamegaya et al. | 315/169.1 |
| 4,302,706 | 11/1981 | Dubois | 315/169.1 |
| 4,315,259 | 2/1982 | McKee et al. | 315/169.4 |
| 4,329,616 | 5/1982 | Holz et al. | 313/584 |
| 4,342,993 | 8/1982 | Holz | 315/169.4 |
| 4,352,040 | 9/1982 | Andreadakis | 313/584 |
| 4,373,157 | 2/1983 | Holz et al. | 315/169.4 |
| 4,378,649 | 4/1983 | Cokefair | 315/169.3 |
| 4,386,348 | 5/1983 | Holz et al. | 315/169.1 |
| 4,414,490 | 11/1983 | Harvey | 315/169.2 |

FOREIGN PATENT DOCUMENTS

| | | | |
|---|---|---|---|
| 2321763 | 3/1977 | France | 313/584 |

*Primary Examiner*—Gene Mancene
*Assistant Examiner*—James R. Hakomaki
*Attorney, Agent, or Firm*—Kevin R. Peterson; Edmund M. Chung; Robert A. Green

[57] ABSTRACT

A gas-filled display panel comprising a glass base plate and a glass face plate hermetically sealed together along a perimeter seal area to form an envelope which is filled with an ionizable gas, the base plate having an array of longitudinal slots in which anode wires are seated and having an array of cathode electrodes on the top surface thereof. The base plate has cross grooves transverse to the slots and positioned one near each end of the base plate, and a glass rod is secured in each cross groove with the ends of each rod lying within the seal area between the base plate and the face plate, the top surface of each insulating member being generally coplanar with the top surface of the base plate in the seal area, to insure the formation of a hermetic seal between the base plate and face plate at the cross grooves.

6 Claims, 3 Drawing Figures

GAS-FILLED DOT MATRIX DISPLAY PANEL

BACKGROUND OF THE INVENTION

A gas-filled dot matrix display panel having memory is disclosed in copending application Ser. No. 051,313, now U.S. Pat. No. 4,386,348, filed June 22, 1979, of George E. Holz and James A. Ogle, which is incorporated herein by reference. This panel includes a matrix of D.C. scanning cells arrayed in rows and columns and a matrix of quasi A.C. display cells which are in operative relation with the scanning cells. In the panel, there is one scan cell for each display cell. The panel includes a relatively complex array of electrodes, and the scanning operation and addressing of display cells are relatively complex procedures.

This panel, in a rather large size, utilizes a cross groove at both ends of the base plate as part of the seal between the base plate and the face plate of the panel. The cross grooves are filled with sealing material which bonds to the face plate. This arrangement works generally satisfactorily; however, at times, the seal material in the cross grooves is of uneven thickness, and this prevents the formation of an hermetic seal between the base plate and face plate. A display panel using a cross groove of this type is shown in U.S. Pat. No. 4,352,040, dated Sept. 28, 1982, of Nicholas Andreadakis, which is incorporated herein by reference.

The present invention solves this problem in a manner described below.

DESCRIPTION OF THE INVENTION

Figure 1:
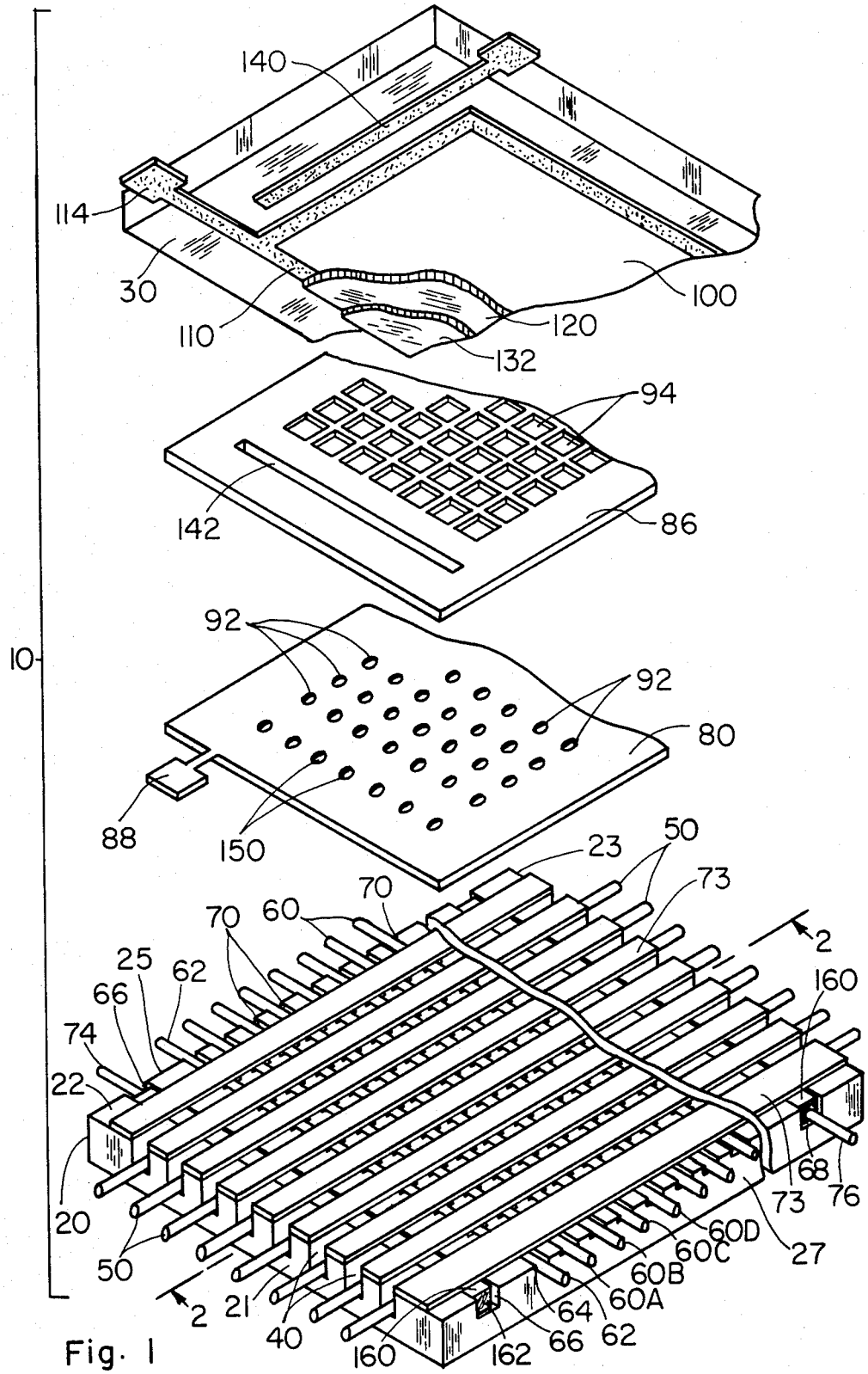
FIG. 1 is a perspective, exploded view, partly in section, of a dot matrix display panel embodying the invention.

The present invention is embodied in a display panel 10 of the type described and claimed in copending application of George E. Holz and James A. Ogle, Ser. No. 051,313, filed June 22, 1979, which is incorporated herein by reference, along with the patents and publications cited therein. This application describes a dot matrix memory display panel including a D.C. scan portion and an A.C. display portion.

The display panel 10 includes a gas-filled envelope made up of an insulating base plate 20 and a glass face plate 30, which are hermetically sealed together, along a closed periphery which surrounds the operating inner portion of the panel and the various gas cells provided therein. The base plate has left and right end edges 21 and 23 and upper and lower edges 25 and 27. The base plate also has a top surface 22, in which a plurality of relatively deep, parallel, longitudinal slots 40 are formed and in each of which a scan anode electrode 50 is seated and secured by means of a glass frit cement.

Figure 2:
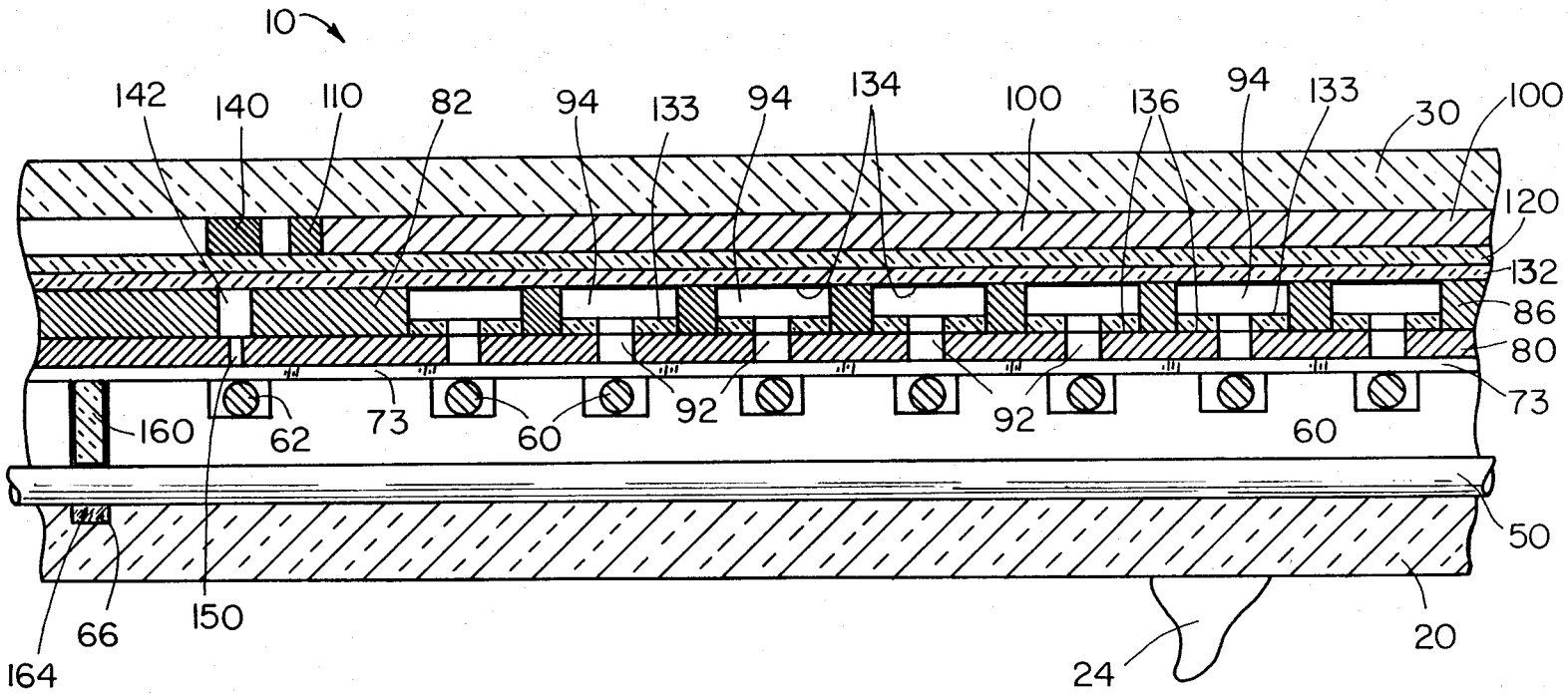
FIG 2 is a sectional view of a portion of the display panel of FIG. 1 taken along lines 2—2 in FIG. 1.

A plurality of cathode electrodes 60 are seated in shallow, parallel slots 70 in the top surface 22 of the base plate. The cathodes 60 are called scan cathodes, and they are disposed transverse to the slots 40 and to scan anodes 50, and each crossing of a scan cathode 60 and a scan anode 50 defines a D.C. scan or scanning cell 72 (FIG. 2). It can be seen that the anodes 50 and cathodes 60 form a matrix of such scanning cells which are arrayed in rows and columns.

The scan cathodes 60A, 60B, 60C, etc., form a series of cathodes which are energized sequentially in a scanning cycle, with cathode 60A being the first cathode energized in the scanning cycle.

A reset cathode electrode 62 is disposed adjacent to and parallel to the first scan cathode 60A, in a slot 64, and, where the reset cathode crosses the scan anodes, a column of reset cells is formed. These reset cells are turned on or energized at the beginning of each scanning cycle, and they generate excited particles which expedite the turn-on of the first column of scan cells associated with cathode 60A.

Adjacent to the reset cathode 62 and its slot 64 and adjacent to end 21 of the base plate is a slot or groove 66, known as a cross groove, which is sufficiently deep so that it extends slightly below the anodes slots 40. A similar cross groove 68 is provided at the opposite end of the base plate.

An insulating layer is provided on the top surface of the base plate. This layer is made up of strips 73 of insulating material extending along each land between the pairs of anode slots 40 and adjacent to the upper and lower edges of the base plate.

Adjacent to the base plate or scan assembly described above is a quasi A.C. display assembly which includes a metal plate electrode 80, known as the priming plate, which has a matrix of rows and columns of relatively small apertures or holes 92, known as priming holes, with each column of priming holes aligned with and overlying one of the cathode portions 61. The plate 80 is positioned close to cathodes 60 and is preferably seated on the layer of insulating strips 73.

Seated on plate 80 is another apertured plate 86, the glow isolator plate, having rows and columns of apertures 94 which are aligned with apertures 92 but are larger than apertures 92. The apertures 94 comprise the display cells of panel 10, and each is disposed above one of the holes 92. The plate 86 may be of insulating material, or it may be of metal. Plates 80 and 86 may be made as one piece, if desired.

The quasi A.C. assembly also includes a face plate assembly which includes a single large-area transparent conductive electrode 100 on the inner surface of the plate 30. A narrow conductor 110, which outlines and reinforces the electrode layer 100 in conductive contact, serves to increase its conductivity, if necessary. The conductor 110 includes a suitable tab 114, to which external connection can be made. The large-area electrode 100 is of sufficient area to overlie the entire array of display cells 94 in plate 86. An insulating coating 120 of glass or the like covers electrode 100.

Under some circumstances, it is desirable to coat the glass layer 120 with a low work function refractory layer 132 of magnesium oxide, thorium oxide, or the like.

In panel 10, the apertures 94 in plate 86 comprise display cells, and, as can be seen in FIG. 2, each display cell has one end wall 134 formed by a portion of insulating layer 132, and an opposite end wall 136 formed by a portion of the top surface of plate 80. To provide cell uniformity and to minimize sputtering, a coating of the material of layer 132 should also be provided on the base or lower wall 136 of each display cell 94, such as the layer 133 shown in FIG. 2.

It appears that optimum operation of the panel is achieved if the apertures or cells 94 are unsymmetrical in that insulating layers 120 and 132 together have a thickness greater than layer 133. Indeed, layer 133 may even be thinner than layer 132. Thus, the lower end wall 136 of each cell 94 will have a very high capacitance coupling to the cell, and layer 133 will consequently tend to form only a minimal wall charge in the operation described below. In one mode of construction, both layer 132 and layer 133 may be formed by an evaporation process, and layer 133 may be so thin that it is not completely continuous, which is a desirable quality. In any case, however, the character of this wall of the cell is affected by the aperture 92 in the metal plate 80.

Panel 10 has a keep-alive arrangement, referred to above, which is described in U.S. Pat. No. 4,329,616 of George E. Holz and James A. Ogle and includes an A.C. electrode 140 in the form of a linear conductive film or layer of opaque metal, such as silver, provided on the inner surface of the face plate 30 adjacent to one edge of the transparent conductive electrode 100. The A.C. keep-alive electrode 140 is positioned so that it is aligned with the column of reset cells and reset cathode 62, to which it supplies excited particles. The A.C. keep-alive electrode 140 is covered by the insulating layers 120 and 132. The plate 86 is provided with a slot 142, and plate 80 is provided with a column of holes 150, the slot 142 overlying and being aligned with the column of holes 150, and both lie beneath and are aligned with the A.C. electrode 140. The slot 142 in the plate 86 is narrower than the opaque A.C. electrode 140 so that a viewer, looking through face plate 30, cannot see any glow which is present in slot 142 and holes 150. Electrode 140 operates with plate 80 to produce glow discharge between them and produce excited particles in slot 142 and holes 150. These excited particles are available to the reset cathode 62 and assist the firing of the column of reset cells.

The gas filling in panel 10 is preferably a Penning gas mixture of, for example, neon and a small percentage of xenon, at a pressure of about 400 Torr. When the panel has been constructed and evacuated, the gas filling is introduced through a tubulation 24 secured to base plate 20 (FIG. 2), or a non-tubulated construction can be employed.

Systems for operating panel 10 are described in application Ser. No. 051,313 and in U.S. Pat. No. 4,315,259 of Joseph E. McKee and James Y. Lee. The operation of panel 10 will not be set forth herein.

The assembly of the panel of the invention and the use of the cross grooves 66 and 68 will now be discussed.

In assembling the panel 10, wires which will form the anodes 50 are wound on a support member, known as a harp, and then they are seated in the grooves 40 in the base plate, with a glass frit cement provided at the ends of the grooves to anchor the ends of the anode wires in place. The same glass frit cement 164 (FIG. 2) is also placed in the cross grooves to secure the anode wires in these grooves.

Figure 3:
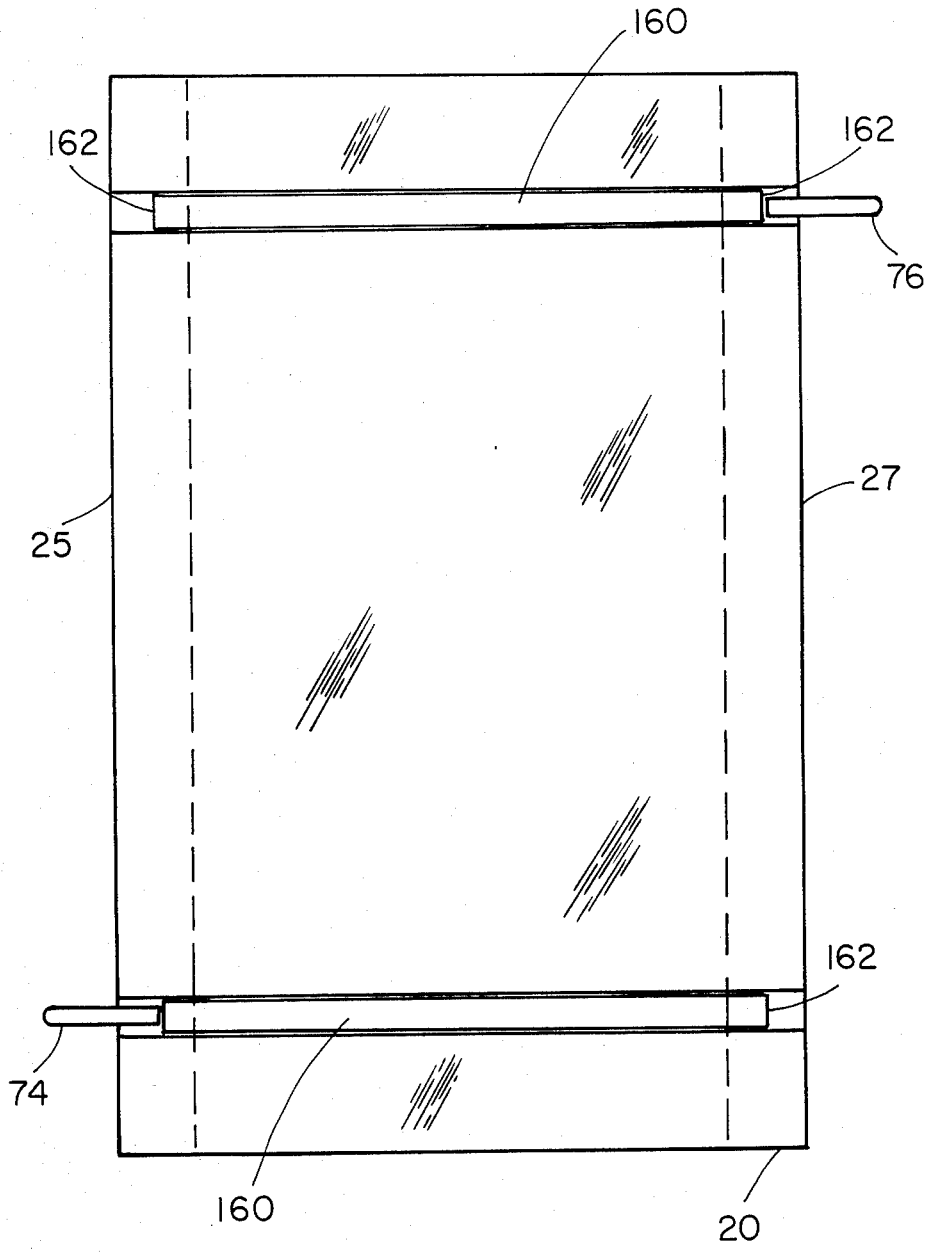
FIG. 3 is a plan view of the base plate portion of the display panel of FIG. 1 showing only selected features of the invention.

The ends of the cross grooves 66 and 68 form a portion of, and lie in the area of, the seal between the face plate and base plate, and, in order to insure that the cross grooves are filled just to the top surface 22 of the base plate, as is required for a proper hermetic seal, a glass rod 160 having a rectangular cross-section is seated in each of the cross grooves on the glass frit cement therein. The rods are designed so that their top surfaces are coplanar with the top surface 22 of the base plate when they are sealed in place, and, as illustrated in FIG. 3, they are sufficiently long so that their ends 162 extend, if not to the edges of the base plate, then near these edges and into the region in which the seal occurs. As shown in FIG. 3, the dash lines represent schematically the extent inwardly from the edges 25 and 27 of the base plate to which the actual seal between the base plate and face plate extends, and it is noted that the ends 162 of the glass rods lie in the seal area.

The glass base plate 20 carrying the anode wires and the glass rods 160 is heated to melt the various quantities of glass frit and to secure the anode wires and the glass rod inserts in place when the assembly cools. A pressure plate is applied to the top surface of the base plate during the heating operation to hold the glass rods 160 in place.

The cathode electrodes 60 and 62 are then provided, and, if the cathodes are wires, they are formed most readily by a winding operation. For such an operation, a short pin 74 is secured in slot 66 but projecting therefrom slightly at upper edge 25 of the base plate, and a similar short pin 76 is secured in the opposite cross groove 68 and projecting therefrom slightly at the lower edge 27 of the base plate. The pins 74 and 76 are secured in the slots with a glass frit cement. When the cathode wire is wound to form the individual cathodes 60 and 62, one end of the wire is secured to pin 74, and then it is wound on base plate 20, with each turn in a slot 70, and the other end is secured to pin 76. Before the actual cathode winding operation is performed, a glass frit is placed in the slots 70 for anchoring the cathode wires in place.

The same general procedure would be followed if the cathodes comprised thin metal strips which were set in place as a unit on the top surface of the base plate.

After this cathode winding operation has been performed and the cathode electrode turns have been secured in place, the wound cathode wire is cut to form the individual cathodes 60 and 62. Finally, the other parts of the panel are assembled with the base plate assembly, and the panel is processed to completion.

What is claimed is:

1. A gas-filled display panel comprising a glass base plate and a glass face plate hermetically sealed together to form an envelope which is filled with an ionizable gas, the seal area between said base plate and face plate extending around the perimeters of said base plate and face plate, said base plate having an array of longitudinal slots in which anode wires are seated, said base plate also having cross grooves transverse to said slots and positioned one near each end of the base plate, each cross groove being deeper than said slots, an electrode in each of said cross grooves adjacent to the base thereof, said seal area covering portions of said cross grooves at the periphery of the panel, an array of cathode electrodes disposed adjacent to and transverse to said anode electrodes and forming an array of rows and columns of gas cells therewith, and an insulating member secured in each cross groove and extending along each cross groove so that the ends of each member lie within the seal area between the base plate and face plate, the top surface of each insulating member being generally coplanar with the top surface of said base plate, at least in said seal area, to insure the formation of a hermetic seal between said base plate and face plate at said cross grooves.

2. The panel defined in claim 1 wherein said cross grooves extend completely across said base plate.

3. The panel defined in claim 1 wherein said anode wires extend across said grooves beneath said insulating members.

4. The panel defined in claim 1 and including an apertured electrode plate disposed adjacent to said base plate and said cathode electrodes with an aperture in operative relation with each of said gas cells, and a large-area electrode on said face plate coated with a layer of glass to make it an A.C. electrode.

5. The panel defined in claim 1 wherein said insulating member is a glass rod.

6. The panel defined in claim 1 wherein said insulating member is a glass rod having a generally rectangular cross-section.

* * * * *